US009167879B2

(12) United States Patent
Gatesoupe et al.

(10) Patent No.: US 9,167,879 B2
(45) Date of Patent: Oct. 27, 2015

(54) PACKAGING AND APPLICATOR DEVICE INCLUDING AN APPLICATOR ROLLER

(75) Inventors: Mathilde Gatesoupe, Ploemeur (FR); Gilles Baudin, Montigny-les-Cormeilles (FR); Marc Lechanoine, Issy-les-Moulineaux (FR); Patrice Barre, Antony (FR); Michel Limongi, Gennevilliers (FR); Franck Seguin, Gennevilliers (FR)

(73) Assignee: L'OREAL, Paris (FR)

( * ) Notice: Subject to any disclaimer, the term of this patent is extended or adjusted under 35 U.S.C. 154(b) by 325 days.

(21) Appl. No.: 12/813,055

(22) Filed: Jun. 10, 2010

(65) Prior Publication Data

US 2011/0017229 A1 Jan. 27, 2011

Related U.S. Application Data

(60) Provisional application No. 61/219,839, filed on Jun. 24, 2009.

(30) Foreign Application Priority Data

Jun. 17, 2009 (FR) ..... 09 54062

(51) Int. Cl.

| | |
|---|---|
| ***A45D 33/00*** | (2006.01) |
| *A45D 33/12* | (2006.01) |
| *A45D 40/26* | (2006.01) |

(52) U.S. Cl.

CPC ..... *A45D 33/006* (2013.01); *A45D 40/261* (2013.01); *A45D 33/12* (2013.01); *A45D 40/26* (2013.01)

(58) Field of Classification Search

CPC ... A45D 34/041; A45D 40/20; A45D 33/006; A45D 33/12; A45D 40/261; A45D 40/26

USPC ..... 132/293–297, 298, 303; 401/175, 216

See application file for complete search history.

(56) References Cited

U.S. PATENT DOCUMENTS 1,704,492 A * 3/1929 Warren ..... 132/120
1,829,105 A * 10/1931 Milne, Jr. ..... 132/295

(Continued)

FOREIGN PATENT DOCUMENTS

EP 1 839 524 A1 10/2007
FR 985.064 2/1949

(Continued)

OTHER PUBLICATIONS

French Preliminary Search Report dated Apr. 15, 2010 in French Patent Application No. 0954062 (with translation).

(Continued)

*Primary Examiner* — Robyn Doan
(74) *Attorney, Agent, or Firm* — Oliff PLC

(57) ABSTRACT

A packaging and applicator device for applying a cosmetic composition including a casing housing at least one composition, in particular in solid-cake form, and an applicator including at least one applicator roller that turns about an axis of rotation for moving over the composition along a rolling direction, the overall dimension of the applicator, measured along the axis of rotation, being less than or equal to a dimension of the composition, measured perpendicularly to the rolling direction of the applicator roller over the composition.

15 Claims, 3 Drawing Sheets

(56) References Cited

U.S. PATENT DOCUMENTS

| | | | | | |
|---|---|---|---|---|---|
| 2,094,312 | A | * | 9/1937 | Weisz | 132/302 |
| 2,140,035 | A | * | 12/1938 | Sundin et al. | 132/299 |
| 2,441,303 | A | * | 5/1948 | Wesson et al. | 132/304 |
| 2,581,267 | A | | 1/1952 | Majewski | |
| 2,664,581 | A | * | 1/1954 | Miller et al. | 132/307 |
| 2,684,497 | A | * | 7/1954 | Graham | 401/197 |
| 3,235,900 | A | * | 2/1966 | Klassen | 401/175 |
| 3,871,390 | A | * | 3/1975 | Spatz | 132/293 |
| 4,898,195 | A | | 2/1990 | Sussman | |
| 5,176,754 | A | * | 1/1993 | Hirzel | 118/258 |
| 6,378,533 | B1 | * | 4/2002 | Roman | 132/295 |
| 6,722,891 | B1 | * | 4/2004 | Ma | 434/409 |
| 7,228,863 | B2 | * | 6/2007 | Dumler et al. | 132/294 |
| 2004/0129284 | A1 | * | 7/2004 | Abergel | 132/200 |
| 2006/0027072 | A1 | | 2/2006 | Morelli | |
| 2006/0275072 | A1 | * | 12/2006 | Petit | 401/208 |
| 2007/0227552 | A1 | * | 10/2007 | Abergel | 132/294 |

FOREIGN PATENT DOCUMENTS

| | | | |
|---|---|---|---|
| FR | 1.261.338 | | 11/1960 |
| FR | 1.524.192 | | 2/1967 |
| FR | 2 882 505 | | 9/2006 |
| FR | 2 903 584 | | 1/2008 |
| GB | 310 755 | | 4/1930 |
| JP | S59-139206 | U | 9/1984 |
| JP | S60-47414 | U | 4/1985 |
| JP | S63-39305 | U | 3/1988 |
| JP | H03-84013 | U | 8/1991 |
| JP | H05-48807 | U | 6/1993 |
| JP | H06-13712 | U | 2/1994 |
| WO | WO 2006/090061 | A1 | 8/2006 |

OTHER PUBLICATIONS

Oct. 1, 2013 Third Party Observation before the Japanese Patent Office regarding Japanese Patent Application No. 2010-137363.

Jun. 30, 2014 Office Action issued Japanese Patent Application No. 2010-137363.

* cited by examiner

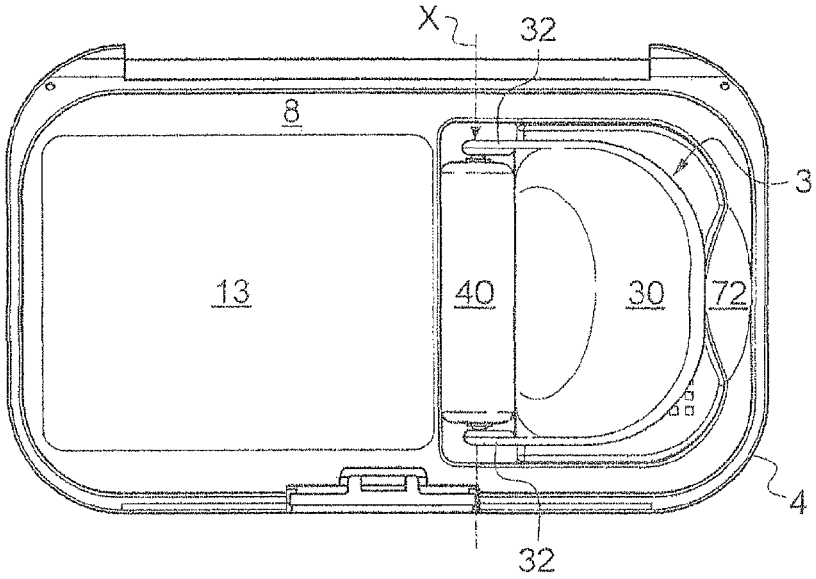
Fig.7
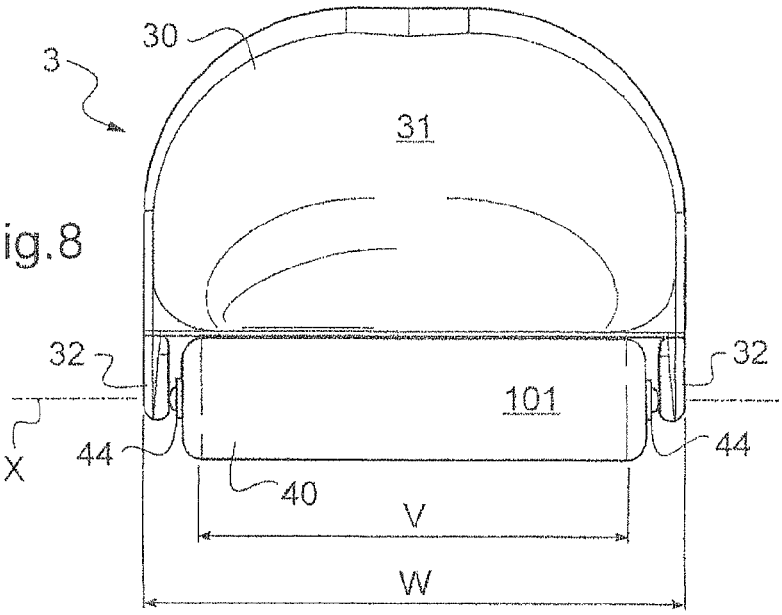
Fig.8
Fig.9
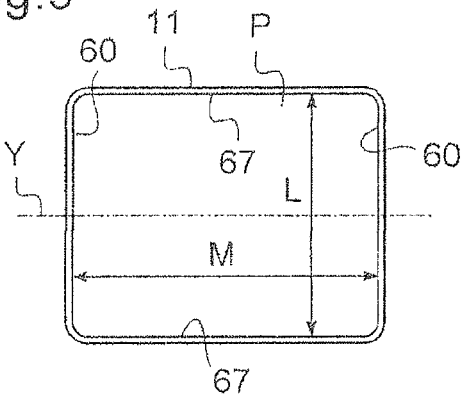
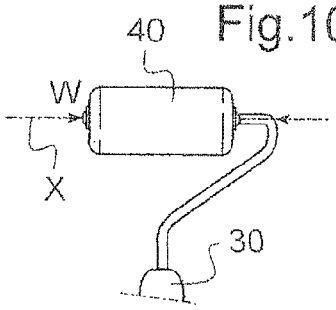
Fig.10

PACKAGING AND APPLICATOR DEVICE INCLUDING AN APPLICATOR ROLLER

FIELD OF THE INVENTION

The present invention relates to packaging and applicator devices for applying a cosmetic composition, and more particularly, but not exclusively, for applying a foundation.

BACKGROUND OF THE INVENTION

In general, cosmetic compositions consisting of a care product and/or of makeup for the skin, and more particularly for the face, are applied by depositing one or more dabs of composition on one or more localized zones of the face, the deposit(s) then being spread using a finger or a sponge so as to cover the entire surface of the face.

This conventional application method does not make it possible to guarantee the composition is of sufficiently uniform thickness over all of the zones of the face. Generally, the zones on which the composition was initially dabbed, benefit from composition that is thicker. In contrast, the zones of the face furthest from those zones are coated in composition more thinly. This lack of uniformity is generally visible in the makeup effect, and is not appreciated by the user when a natural look is desired.

It has also been proposed to apply liquid foundations using applicators comprising a block of foam that, during application, may be secured to a reservoir containing the composition, or in variants, may be separate therefrom.

Patents FR 985 064 and FR 1 524 192, and applications FR 2 882 505 and US 2006/027072 disclose packaging and applicator devices each comprising an applicator roller that is secured to a reservoir containing the composition for application.

Patent 1 281 338 describes an applicator with an applicator roller that is constituted by the composition itself.

Application FR 2 903 584 discloses an eyeliner applicator including an applicator wheel that makes it possible to draw a relatively fine line on the skin. The wheel may be loaded with composition on bringing it into contact with the composition prior to application.

OBJECT AND SUMMARY OF THE INVENTION

There exists a need to improve still further packaging and applicator devices for applying a cosmetic composition.

The invention achieves this by means of a packaging and applicator device for applying a cosmetic composition, the device comprising:

- a casing housing at least one composition, preferably in solid-cake form; and
- an applicator including at least one applicator roller that turns about an axis of rotation for moving over the composition along a rolling direction, the overall dimension of the applicator, measured along the axis of rotation being less than or equal to a dimension of the composition, measured perpendicularly to the rolling direction of the applicator roller over the composition.

By means of the invention, the applicator roller may be loaded easily with composition, which composition may also be applied easily, while achieving a deposit that is relatively uniform.

The term "roller" should be understood to mean that the length of the surface that comes into contact with the composition and that is used for application, as measured along the axis of rotation, is greater than the greatest diameter of said surface, and, by way of example, is more than 1.5, or even more than 2 or 3 times the diameter.

The term "solid composition" should be understood to mean a composition of high consistency that preserves its shape during storage, and that, unlike "fluid compositions", does not flow under its own weight. Preferably, as indicated above, the composition is in the form of a solid cake. In variants, it is semi-solid, in particular creamy.

The fact that the dimension of the applicator, measured along the axis of rotation, is less than or equal to the dimension of the composition, measured perpendicularly to the rolling direction of the applicator member on the composition, makes it possible for the applicator to penetrate deeper into the casing as the composition is used up.

The applicator roller may roll directly in contact with the cake of composition, without any intermediate grid or mesh. In a variant, the composition is taken through a grid or a mesh that lies on the composition. In this situation, the applicator roller rolls over the grid or the mesh that may penetrate deeper into the housing containing the composition, as said composition is used up.

Preferably, the dimension of the composition, measured along the rolling direction, is greater than or equal to a circumference of the applicator roller in a zone of said applicator roller that comes into contact with the composition while the applicator is being loaded with composition. In particular, the dimension may be greater than or equal to twice said circumference. This enables the applicator roller to perform at least one complete revolution on rolling over the composition, and thus enables the user to load the entire working surface of the applicator roller with composition that is relatively uniform in a single pass over the composition, moving said roller from one end of the composition to the other.

The applicator may be made in various ways. Preferably, the applicator includes lugs and the applicator roller turns between the lugs. The applicator includes a handle. The handle may be molded out of plastics material integrally with the lugs.

The casing may include a housing for receiving the applicator when not in use. The bottom of the housing may have at least one ventilation hole passing therethrough.

The housing may be configured in such a manner as to orientate the applicator to slope upwards when the casing lies on a horizontal plane surface. Thus, the user may take hold of the applicator more easily on opening the casing.

In particular exemplary embodiments, the housing includes two ramps against which the applicator may bear when it lies in the housing, the ramps making it possible to orientate the applicator to slope upwards. In particular, the presence of ramps may enable a ventilation grid to be provided in the bottom of the housing, extending between the ramps. A gap may exist between the handle and the grid that is sufficient to enable the housing containing the applicator to be properly ventilated.

In an embodiment of the invention, the casing is configured to hold the applicator roller away from a lid of the casing when the lid is closed, in the event of the casing being turned upsidedown.

For example, the casing may include two abutments under which the above-mentioned lugs of the applicator are engaged in such a manner as to avoid the applicator roller coming into contact with a lid when said lid is closed. This makes it possible, when the casing is turned upsidedown, to avoid transferring composition onto the inside face of the lid, which could be troublesome, in particular when the lid is made out of a transparent material.

The handle of the applicator may have a dimension, along a direction that is perpendicular to the axis of rotation, that is sufficient to hold the applicator in the housing against any movement of said applicator in a direction that is perpendicular to the axis of rotation, or at the very least to limit its movement to a stroke that is not sufficient to enable the applicator to escape from the above-mentioned abutments. The applicator may also be held in some other way.

The composition may be any cosmetic, makeup, or care product composition, e.g. being cast or compacted.

In particular, the composition may be cast or compacted in a dish that is fitted in a housing of the casing. The term "cast composition" means a mass of composition having cohesion that is provided by solidification of at least one of its components during manufacture. The composition may be hot cast in a dish and solidification may result from it cooling.

When the composition is cast, it may shrink, on cooling or on drying, so that the composition initially has a top surface that is not completely plane, with a small depression.

In longitudinal section, the profile of the roller may have a shape that matches the shape of the surface of the composition on first use, so as to enable the application surface to be loaded uniformly as from first use, and in particular so as to avoid any greater quantity of composition being deposited close to the edges. The surface of the roller that is used for application may be circularly cylindrical, or a little egg-shaped.

Other exemplary embodiments of the invention also provide a method of applying a cosmetic composition, in which method a device as defined above is used.

In other exemplary embodiments, and independently or in combination with the above, the invention also provides a packaging and applicator device for applying a cosmetic composition, the device comprising:

a casing housing a composition; and an applicator including an applicator roller that turns about an axis of rotation for moving over the composition along a rolling direction, the applicator being received in a housing of the casing;

the housing being configured in such a manner as to orientate the applicator to slope upwards when the casing lies on a horizontal plane surface.

The housing may include two ramps against which a handle of the applicator may bear when the applicator lies in the housing, the ramps making it possible to orientate the handle to slope upwards. The bottom of the housing may include a ventilation grid that extends between the ramps.

In other exemplary embodiments, and independently or in combination with the above, the invention also provides a packaging and applicator device for applying a cosmetic composition, the device comprising:

a casing including a lid and housing a composition; and an applicator comprising:

two lugs; and an applicator roller that is disposed between the lugs and that turns about an axis of rotation for moving over the composition along a rolling direction;

the casing being configured to hold the applicator roller away from the lid of the casing when the lid is closed, in the event of the casing being turned upsidedown. By way of example, the casing may include two abutments under which the lugs of the applicator may be engaged in such a manner as to avoid the applicator roller coming into contact with the lid when said lid is closed and the casing is turned upsidedown. The lid may be transparent at least in part.

BRIEF DESCRIPTION OF THE DRAWINGS

The invention can be better understood on reading the following detailed description of non-limiting embodiments thereof, and on examining the accompanying drawings, in which:

FIG. 7 is a plan view showing the variant embodiment in FIG. 6;

FIG. 8 shows a face view of the applicator shown in isolation;

FIG. 9 is a plan view of the cake of composition in its dish; and

FIG. 10 shows a variant of an applicator.

MORE DETAILED DESCRIPTION

Figure 1:
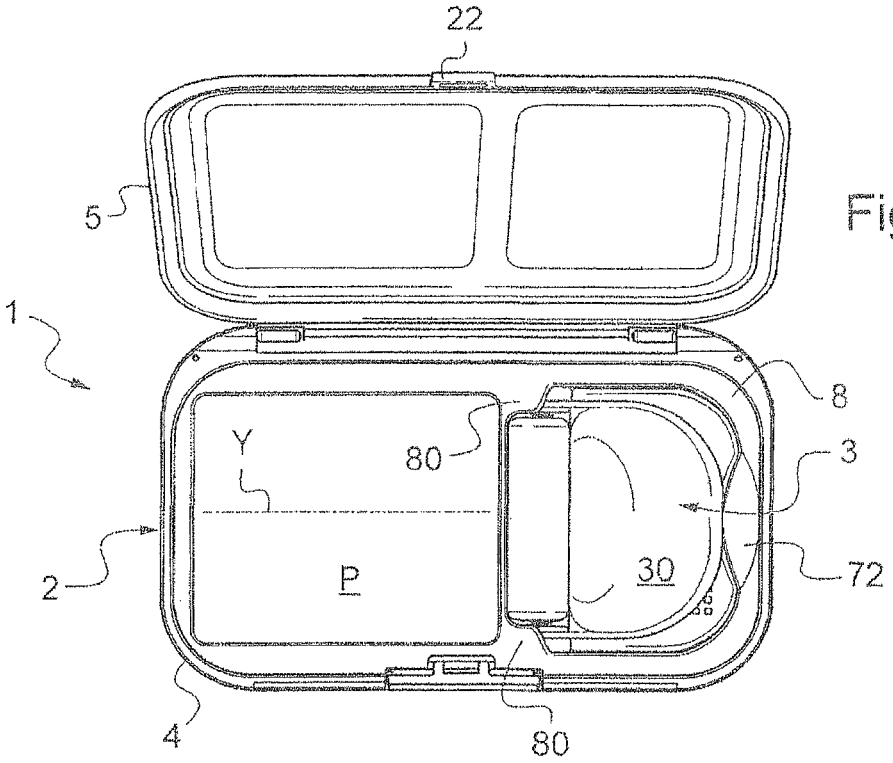
FIG. 1 is a diagrammatic perspective view from above showing an embodiment of a packaging and applicator device made in accordance with the invention.
Figure 2:
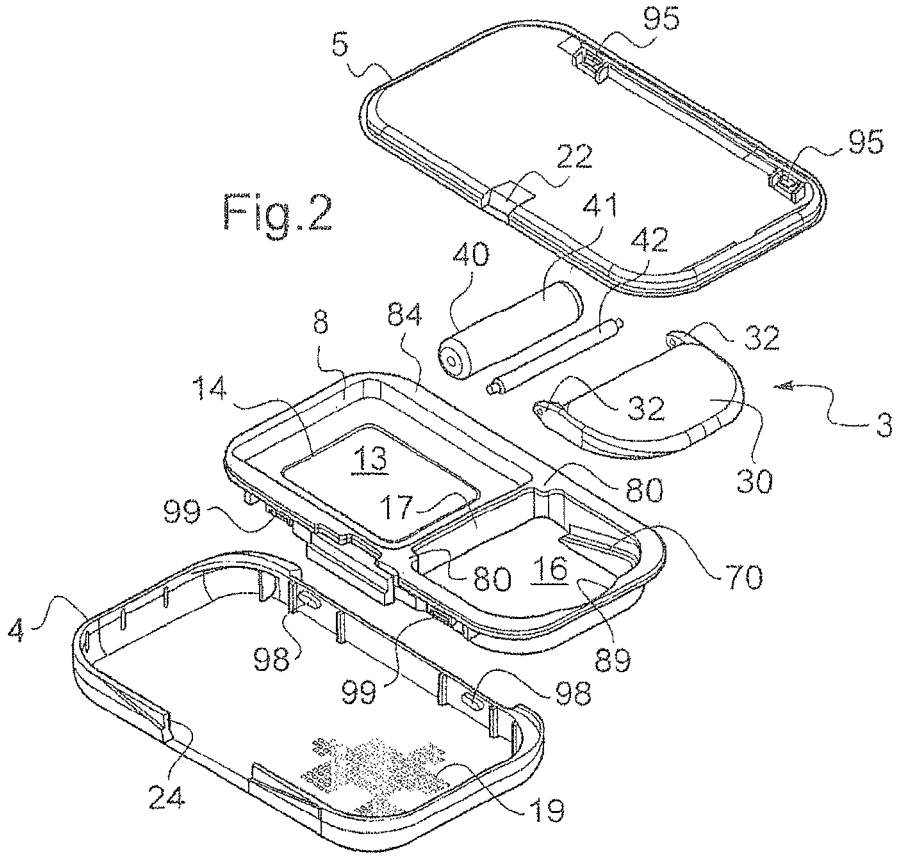
FIG. 2 is an exploded perspective view of the FIG. 1 device, without the composition dish.
Figure 3:
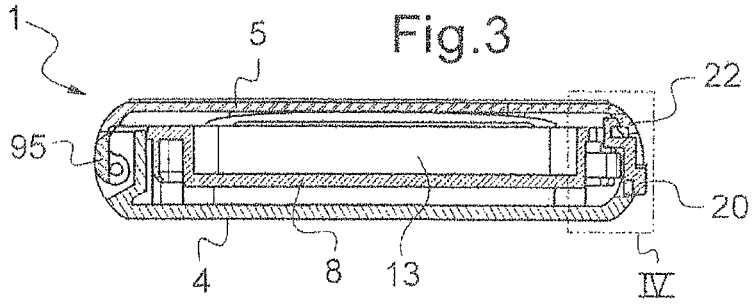
FIG. 3 is a cross section of the FIG. 2 casing.
Figure 4:
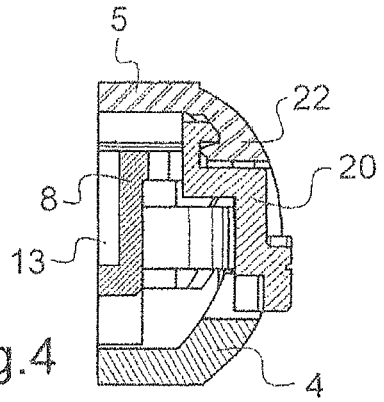
FIG. 4 shows a detail IV of FIG. 3.

The packaging and applicator device 1 shown in FIGS. 1 to 5 comprises a casing 2 and an applicator 3 that is suitable for being removed by the user from the casing 2 in order to apply composition.

The casing 2 includes a base 4, e.g. of generally rectangular outline when observed from above, on which a lid 5 is hinged, e.g. about a pivot axis that is parallel to a long side of the base 4, as shown. The lid 5 may be hinged on the base 4 in known manner, by means of two hinges 95.

The device 1 also includes a tray 8 that is fastened in the base 4, e.g. by snap-fastening, and that receives a mass of cosmetic composition P, e.g. in the form of a cast or compacted cake. The base 4 may be made with fastener portions in relief 98, and the tray 8 may include corresponding tabs 99 that are adapted to snap-fasten in the portions in relief.

The lid 5 is advantageously made out of a transparent thermoplastic material.

By way of example, the cosmetic composition P is selected from amongst makeup for making up the skin or the lips, in particular a foundation, but may also be a care product or a self-tan. The composition P may also be a sunscreen preparation or a deodorant.

By way of example, the dish 11 is a dish that is pressed out of metal, and it is of substantially rectangular shape, as shown.

The dish 11 is received in a housing 13 of the tray 8 of corresponding shape, specifically of generally rectangular outline having rounded corners.

The dish 11 may be fastened in various ways in the housing 13 of the tray 8, e.g. being bonded in the housing. Said housing may include a rib 14 for compensating for the thickness of a thread of adhesive disposed in the bottom of the housing 13 so as to ensure that the dish 11 is held in place.

Beside the first housing 13, the casing 2 includes a second housing 16 for receiving the applicator 3 when said applicator is not in use.

By way of example, and as shown, the housing 16 is defined by an opening in the tray 8, and separated from the housing 13 by a partition 17.

In the embodiment under consideration, the bottom of the housing 16 is defined by the base 4 and includes a ventilation grid 19.

The tray 8 may include a clasp 20 that is molded integrally with the tray 8, for example, and that may come into engagement with a fastener tab 22 of the lid 5 so as to close said lid.

The base 4 may include a recess 24 for housing the clasp 20 when the tray 8 is fastened thereon. The tray 8 may be metal-plated on its visible top face.

As shown in FIG. 8, the applicator 3 includes a handle 30 that presents a flat shape, preferably with a recess 31 on each of its main faces, so as to make it easier to grip.

The handle 30 is extended at its distal end by two lugs 32 that are molded integrally therewith, and that serve as bearings for turning an applicator roller 40 about an axis of rotation X. By way of example, and as shown, the axis X is orientated perpendicularly to the longitudinal axis of the handle 30. The flat direction may be parallel to the axis X.

The applicator roller 40 comprises a hollow applicator portion 41 through which a support pin 42 passes, said support pin having ends with shoulders at 44, as can be seen in FIG. 8, and that are engaged in holes passing through the lugs 32. In a variant, the holes receiving the ends of the support pin may be blind. In this situation, the ends of the support pin need not have shoulders.

By way of example, the applicator portion 41 is made out of a foam having open or closed cells, but other materials may be suitable, e.g. elastomer or sintered materials. The surface that is used for application may be flocked, where appropriate, or may include fibers resulting from subjecting the foam to an abrasive treatment.

The support pin 42 may be made out of thermoplastic material, in particular out of the same material as the material that is used to make the handle 30 and the lugs 32.

Beside the applicator roller 40, the handle 30 may include two walls 46 that flare apart from each other on going towards the applicator roller 40, the walls 46 defining, in part, the recesses 31 on each of the main faces of the handle 30.

In order to load the applicator roller 40 with composition P, the user rolls it over the cake of composition, moving along an axis Y that is perpendicular to the axis of rotation X, and that is parallel to the long side of the cake of composition P in the embodiment under consideration. The direction Y is advantageously parallel to the long side of the casing 4, so as to make it easier to use the applicator with one hand while holding the casing with the other.

The overall dimension W of the applicator 3, measured between the outside faces of the lugs 32, is less than the dimension L of the cake of composition P, measured between the facing inside faces 67 of the dish 11, in a direction that is perpendicular to the axis Y, thereby making it possible for the applicator to penetrate into the dish 11 without the lugs 32 hindering such penetration, as the cake of composition P is used up. By way of example, $|L-W| \leq 1$ millimeters (mm).

The greatest perimeter of the roller 40, in a zone of the applicator portion 41 that comes into contact with the cake of composition P while the applicator is being loaded with composition, is advantageously less than the dimension M of the dish 11, measured between its facing inside faces 60 along the axis Y, so as to enable the applicator roller 40 to turn through at least one complete revolution when the user moves it along the axis Y from one side of the dish 11 to the other, e.g. from left to right or vice versa in FIG. 1.

Preferably, the distance M is at least twice the greatest circumference of the applicator roller 40, so that the applicator turns at least twice in contact with the cake of composition P when the user moves it over the cake of composition.

In the embodiment under consideration, the surface 101 that is used for application is circularly cylindrical of axis X, of diameter d, and thus preferably $d \leq 2\ M/\Pi$.

By way of example, the diameter d is about 10 mm, and the length M lies in the range 50 mm to 60 mm. By way of example, the distance L lies in the range 40 mm to 50 mm, as does the width W. By way of example, the length V of the surface 101 lies in the range 32 mm to 36 mm.

Figure 5:
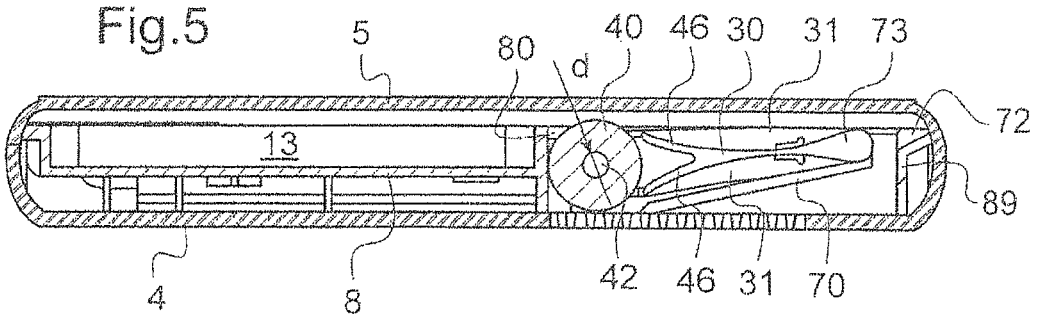
FIG. 5 is a longitudinal section of the FIG. 1 casing.

In addition, in order to make it easier to take hold of the applicator 3 on opening the casing 2, said casing advantageously includes a housing 16, as shown, with two ramps 70 that are disposed on the longitudinal sides of the tray 8, and, as can be seen in particular in FIG. 5, that are orientated to slope upwards away from the cake of composition P. The angle of the ramps 70 relative to the horizontal lies in the range 10° to 20°, for example.

The casing 2 may include a recess 72 on its side situated remote from the cake of composition P, so as to make it easier to engage a finger in order to take hold of the handle 30 of the applicator. By way of example, the user may lift up the handle 30 with the index finger, while the roller 40 is substantially stationary, then take hold of the handle 30, lifted up in this way, between the thumb and the index finger.

The slope of the ramps 70 may be selected in such a manner that the end 73 of the handle 30, that is remote from the applicator roller 40 is situated in the vicinity of, or even in contact with, the inside face of the lid 5 when the casing is closed, and that may contribute to holding the applicator 3 in place in the housing 16 when the casing is closed, or, at the very least, may contribute to reducing any movement of the applicator inside its housing when the casing is turned upsidedown.

The casing 2 may include abutments 80, formed with the tray 8 in the embodiment under consideration, under which the lugs 32 of the applicator 3 are engaged when said applicator is in place in the housing 16, thereby making it possible to avoid the applicator roller 40 coming into contact with the lid 5 when the casing 2 is closed and turned upsidedown, so as to avoid soiling the lid.

The abutments 80 may be formed by the top wall 84 of the tray 8 extending towards the inside of the housing 16. The spacing between the abutments 80 and the bottom of the housing 16 advantageously corresponds substantially to the width of a lug 32.

In order to hold the lugs 32 under the abutments 80, the dimension of the handle 30, measured perpendicularly to the axis of rotation X, may be selected in such a manner that the handle 30 comes to bear against the tray side wall 89 that defines the housing 16 on the side remote from the cake of composition P. The handle 30 may also come into contact with the lid 5 when said lid is closed, or may be situated a short distance from the lid, e.g. less than 1 mm therefrom.

Where appropriate, the presence of the ramps 70 may also make it possible to take hold of the applicator by sliding it outwards over the ramps 70 through a distance that is sufficient for the handle to overhang the side of the casing and enable the user to take hold of it between two fingers.

During application, the applicator roller 40 may turn without sliding over the skin. A plurality of successive passes may be performed at a single location, e.g. depending on the intensity of color that is desired. During successive passes, the user may change the rolling direction a little, so as to blend in the edges of the deposit of composition, where appropriate.

Naturally, the invention is not limited to the embodiment described above.

Figure 6:
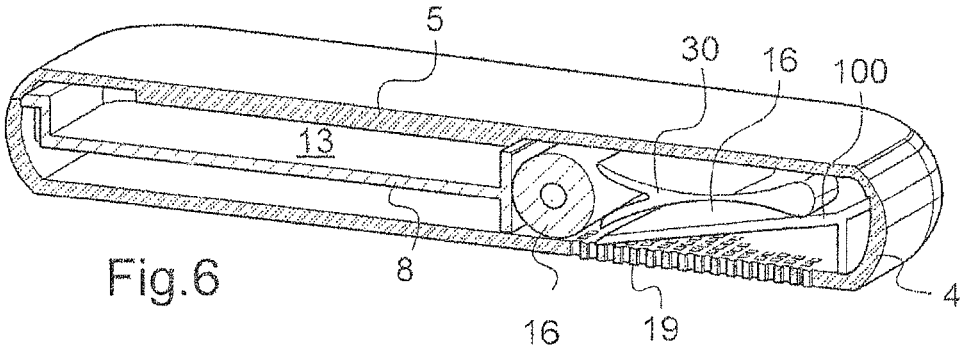
FIG. 6 is a view similar to FIG. 5 showing a variant embodiment.

In particular, it is possible to replace the two ramps 70 by a sloping grid 100, as shown in FIG. 6, the grid 100 possibly being made integrally with the tray 8, or independently thereof and fitted in the base 4.

It is also possible to make the casing 1 without abutments 80, as shown in FIG. 7.

The applicator may include more than one roller, e.g. two rollers disposed one behind the other, or in line with each other. The casing may house two different compositions contained in respective dishes, for example.

The applicator roller 40 may alternatively be connected to the handle 30 on one side only, as shown in FIG. 10.

A grid or a mesh may possibly be disposed in the housing receiving the composition, so as to limit the quantity of composition that is loaded on the applicator roller while it is moving in said housing, over the grid or mesh. A grid or mesh may be useful in particular when the composition is semi-solid, e.g. creamy.

The expression "comprising a" should be understood as being synonymous with "comprising at least one" unless specified to the contrary.

What is claimed is:

1. A cosmetic packaging and applicator device comprising:

a casing housing a single cosmetic composition, the cosmetic composition being in the form of a solid cake; and an applicator to apply the cosmetic composition, the applicator comprising at least one applicator roller configured to turn about an axis of rotation and for moving over while in contact with the composition in a rolling direction, an overall dimension of the applicator, measured along the axis of rotation, being less than or equal to a dimension of the cosmetic composition measured perpendicularly to the rolling direction of the applicator roller over the composition, the applicator comprising lugs between which the applicator roller turns, the applicator further comprising a handle that is integrally molded with the lugs out of plastics material, and the casing comprising two abutments under which the lugs of the applicator are engaged so as to avoid the applicator roller coming into contact with a lid of the casing when said lid is closed position, when the casing is turned upsidedown.

2. The device according to claim 1, the dimension of the cosmetic composition, measured along the rolling direction, being greater than or equal to a circumference of the applicator roller in a zone that comes into contact with the composition while the applicator is being loaded with composition.

3. The device according to claim 2, the dimension of the composition along the rolling direction, being greater than or equal to twice said circumference.

4. The device according to claim 1, the casing comprising a housing for receiving the applicator when the applicator is not in use.

5. The device according to claim 4, said housing configured so as to orient the applicator to slope upwards when the casing lies on a horizontal plane surface.

6. The device according to claim 5, said housing including two ramps against which the applicator bears when it lies in the housing, the ramps orientating the applicator to slope upwards.

7. The device according to claim 6, a bottom of the housing having at least one ventilation hole passing therethrough, and the bottom of the housing including a ventilation grid that extends between the two ramps.

8. The device according to claim 4, a bottom of the housing having at least one ventilation hole passing therethrough.

9. The device according to claim 4, the applicator comprising a handle extending in a direction that is perpendicular to the axis of rotation, and that is configured to hold the applicator in the housing against movement in a direction perpendicular to the axis of rotation.

10. The device according to claim 1, the casing being configured to hold the applicator roller away from a lid of the casing when the lid is in a closed position.

11. The device according to claim 1, being cast.

12. The device according to claim 1, a profile of the applicator roller in the longitudinal section matching a profile of the surface of the composition on first use.

13. A method of applying a cosmetic composition to the skin comprising:

moving the applicator as defined in claim 1, over the composition, so as to load the applicator with composition by rolling the applicator roller over the surface of the composition, and applying the roller loaded in this way with composition to the skin.

14. A cosmetic packaging and applicator device comprising:

a casing housing at least one cosmetic composition; and an applicator to apply the at least one cosmetic composition, the applicator comprising at least one applicator roller configured to turn about an axis of rotation and for moving over while in contact with the at least one cosmetic composition in a rolling direction, an overall dimension of the applicator, measured along the axis of rotation, being less than or equal to a dimension of the at least one cosmetic composition measured perpendicularly to the rolling direction of the applicator roller over the at least one composition, the casing comprising a housing for receiving the applicator when the applicator is not in use, said housing configured so as to orient the applicator to slope upwards when the casing lies on a horizontal plane surface, the housing including two ramps against which the applicator bears when it lies in the housing, the ramps orientating the applicator to slope upwards.

15. A cosmetic packaging and applicator device comprising:

a casing housing at least one cosmetic composition; and an applicator to apply the at least one cosmetic composition, the applicator comprising at least one applicator roller configured to turn about an axis of rotation and for moving over while in contact with the at least one composition in a rolling direction, an overall dimension of the applicator, measured along the axis of rotation being less than or equal to a dimension of the at least one cosmetic composition measured perpendicularly to the rolling direction of the applicator roller over the at least one composition, the applicator comprising lugs between which the applicator roller turns, the applicator further comprising a handle that is integrally molded with the lugs out of plastics material, the casing comprising two abutments under which the lugs of the applicator are engaged so as to avoid the applicator roller coming into contact with a lid of the casing when said lid is in closed position, when the casing is turned upsidedown.

* * * * *